US007053336B1

(12) United States Patent
Cheng

(10) Patent No.: US 7,053,336 B1
(45) Date of Patent: May 30, 2006

(54) HEATING ELEMENT AUTOBALANCE DEVICE

(75) Inventor: Hsien-Kuan Cheng, P.O. Box No. 6-57, Junghe 235 (TW)

(73) Assignees: Hsien-Kuan Cheng, Yingge (TW); Yung-Heng Chen, Taipei (TW)

( * ) Notice: Subject to any disclaimer, the term of this patent is extended or adjusted under 35 U.S.C. 154(b) by 54 days.

(21) Appl. No.: 11/044,192

(22) Filed: Jan. 28, 2005

(51) Int. Cl.
*H05B 1/00* (2006.01)

(52) U.S. Cl. ..... 219/201; 219/536

(58) Field of Classification Search ..... 219/201, 219/521, 525, 526, 536, 537, 453.11, 453.12, 219/453.13
See application file for complete search history.

(56) References Cited

U.S. PATENT DOCUMENTS 5,032,157 A * 7/1991 Ruff ..... 62/532
5,212,957 A * 5/1993 Ruff ..... 62/124
6,552,306 B1 * 4/2003 Edmonds ..... 219/438
6,593,554 B1 * 7/2003 Danko et al. ..... 219/536
6,596,974 B1 * 7/2003 Howard et al. ..... 219/536
6,621,056 B1 * 9/2003 Sherrill ..... 219/536
6,624,398 B1 * 9/2003 Sherrill et al. ..... 219/536
6,723,968 B1 * 4/2004 Danko et al. ..... 219/536

* cited by examiner

*Primary Examiner*—Robin O. Evans
*Assistant Examiner*—Vinod Patel

(57) ABSTRACT

A heating element autobalance device includes a fixing mount, a balance device, a heating element, a top cover, a bottom cover and a base, wherein the fixing mount is disposed in the top cover, The balance device is configured atop the fixing mount, and is structured to include large rockers and small rockers, wherein the small rockers are separately configured on another side of each of the large rockers for disposing the heating element thereon, thereby achieving effectiveness and suitability for placing any body to be heated atop the heating element. The heating element penetrates the fixing mount and is fixedly configured atop insulation boards. Upon a body to be heated presses downwards and thereby comes in contact with the heating element, the balance device is thereby actuated, which effectuates clinging of the heating element to the body to be heated, and thus achieves effectiveness of even heating.

2 Claims, 7 Drawing Sheets

HEATING ELEMENT AUTOBALANCE DEVICE

BACKGROUND OF THE INVENTION (a) Field of the Invention

The present invention relates to a heating element autobalance device, more particularly to employ a double balance principle and body thermal expansion and cold contraction to effectuate a rise and fall fluctuation in a heating element.

b) Description of the Prior Art

A conventional heating element is installed directly atop a main body, as depicted in FIG. 1, and when a body to be heated is placed onto the heating element, because of principle of thermal expansion and cold contraction, the heated body becomes arcuate, thus resulting in only three points of the body to be heated coming in contact with the heating element, which thereby causes unequal heating of the body, and brings about inconvenience to a user.

Moreover, the conventional heating element is not appropriate for placing of a relatively small body to be heated thereon, because if such should be accordingly placed, an outer portion of the heating element would be exposed, easily resulting in a dangerous predicament, and which is often a cause for serious injury to the user.

Hence, the inventor of the present invention proposes to resolve and surmount existent technical difficulties in eliminating the aforementioned shortcomings.

SUMMARY OF INVENTION

The present invention is to provide a heating element autobalance device by employing distinctive features of a double balance principle and body thermal expansion and cold contraction to effectuate a rise and fall fluctuation in a heating element. Upon heating the body to be heated, single surface expansion of the body results, thus resulting in an arcuate formed surface thereof. Furthermore, when the heating element is subjected to pressing down by a heavy weight of the body to be heated, a raising upward of a rear portion of the heating element is realized by means of a seesaw principle, realizing clinging of the heating element to the body to be heated, which thus presents largest surface area to be heated to the heating element, thereby achieving objective of even heating.

To enable a further understanding of the said objectives and the technological methods of the invention herein, the brief description of the drawings below is followed by the detailed description of the preferred embodiment.

DETAILED DESCRIPTION OF THE PREFERRED EMBODIMENTS

Figure 1:
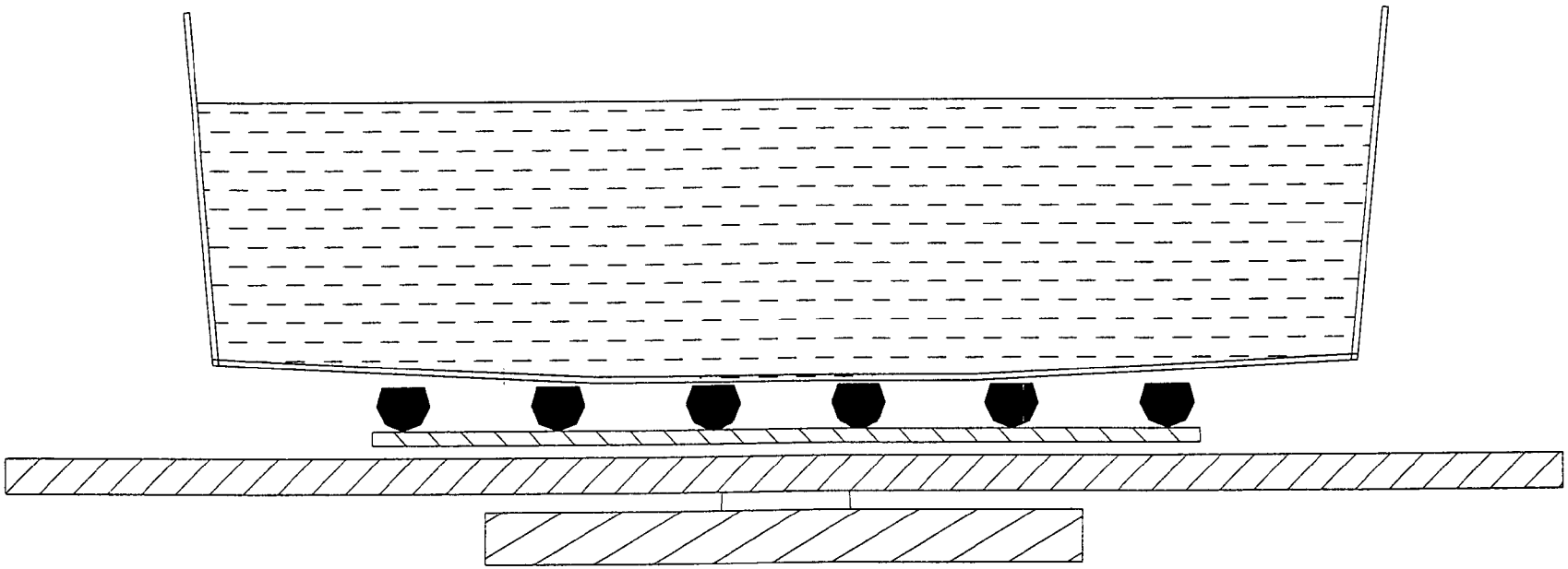
FIG.1 Prior Art
FIG. 1 shows a schematic planar view of conventional art.
Figure 2:
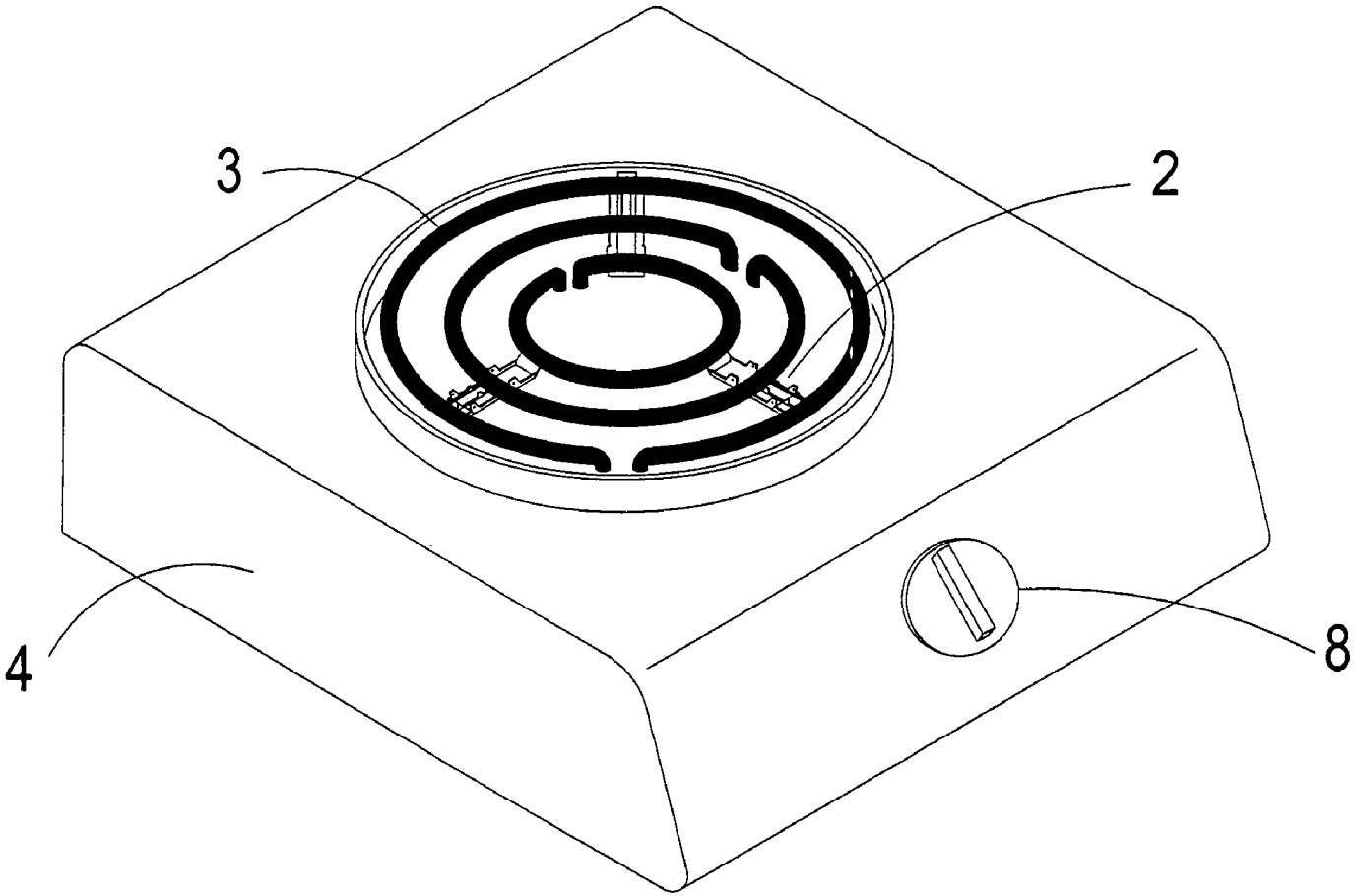
FIG. 2 shows a schematic elevational view of a heating element autobalance device according to the present invention.
Figure 3:
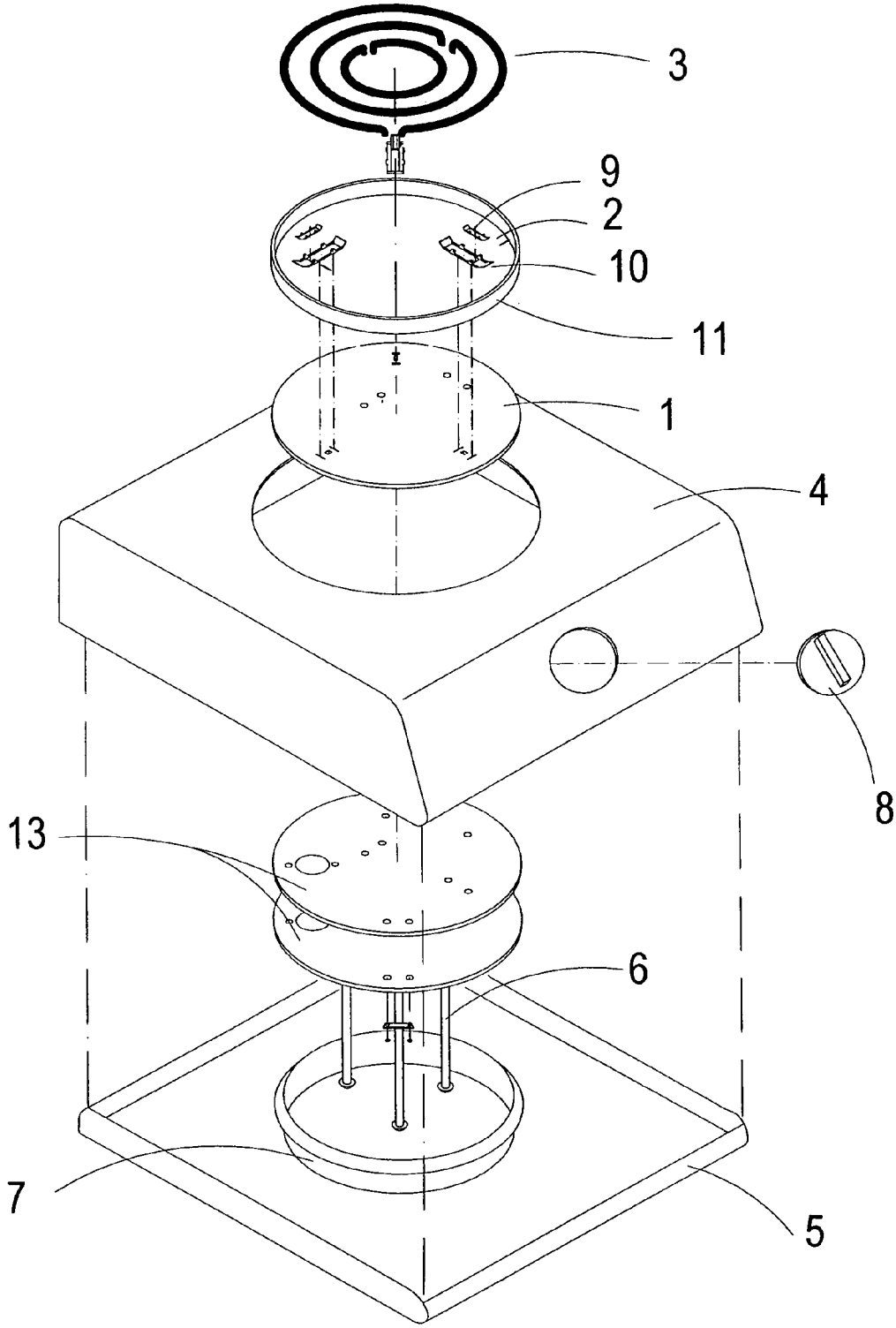
FIG. 3 shows an exploded elevational view of the heating element autobalance device according to the present invention.

Referring to FIGS. 2 and 3, which show the present invention structured to comprise a fixing mount 1, a balance device, a heating element, a top cover 4, a bottom cover 5 and a base 7.

Figure 4:
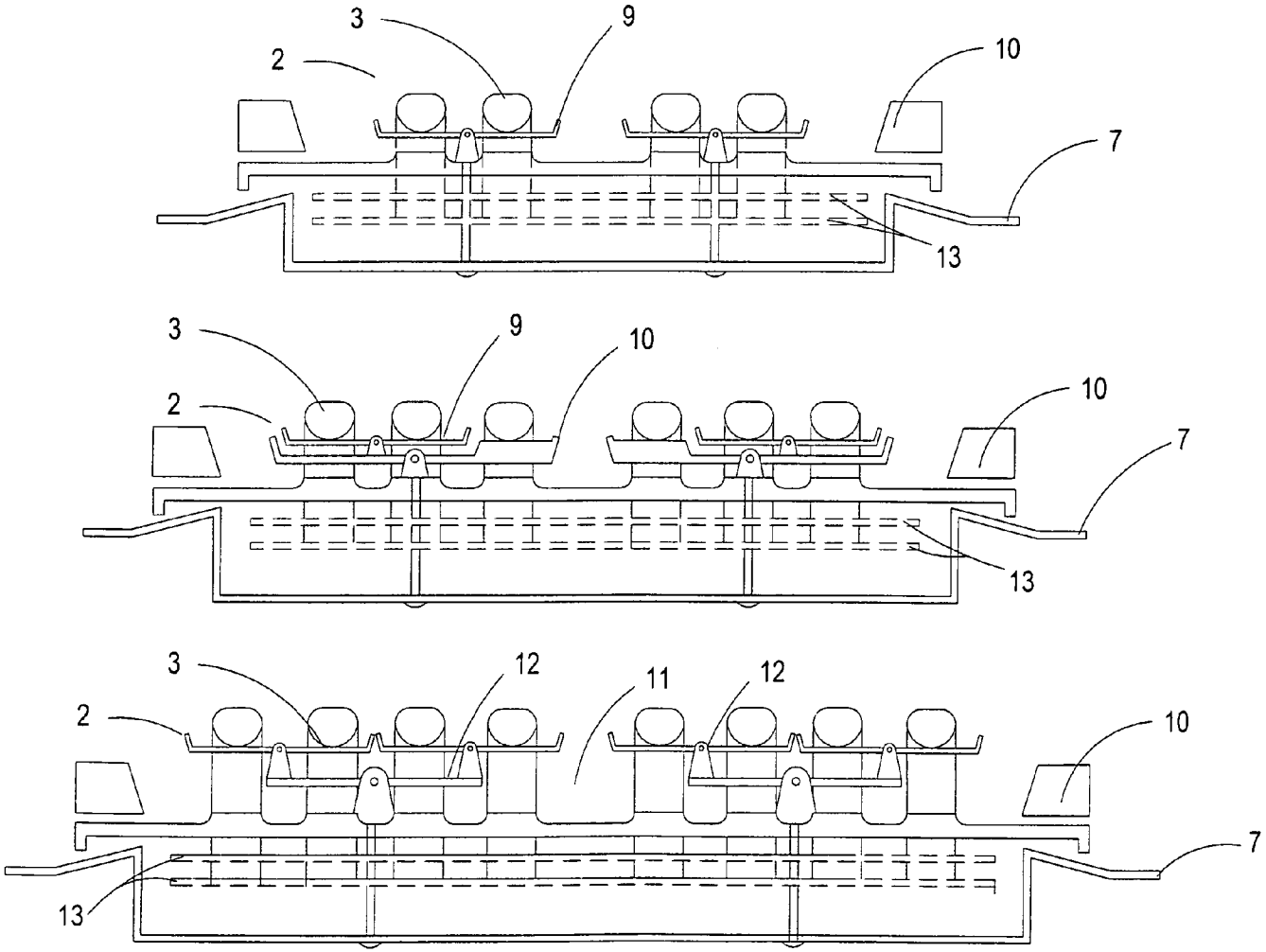
FIG. 4 shows a schematic planar view of heating elements, depicting increase in number of rings according to requirements according to the present invention.

Wherein, the fixing mount 1 is disposedly configured in the top cover 4. Moreover, a blocking ring 11 is configured atop the fixing mount 1, and functions in coordination with the lower base to achieve effectiveness of obviating stains arising from spillage (see FIG. 4). Furthermore, the fixing mount 1 is fixedly configured on the base 7 by means of support rods 6, and a power switch 8 is configured to one side of the top cover 4, providing a switch to a power supply therewith.

Wherein, the balance device is configured atop the fixing mount 1. The balance device is structured to embody large rockers and small rockers. The small rockers are configured on another side of each of the large rockers, and which provide for disposing the heating element thereon, thereby achieving effectiveness and suitability for placing any body to be heated atop the heating element.

Figure 5:
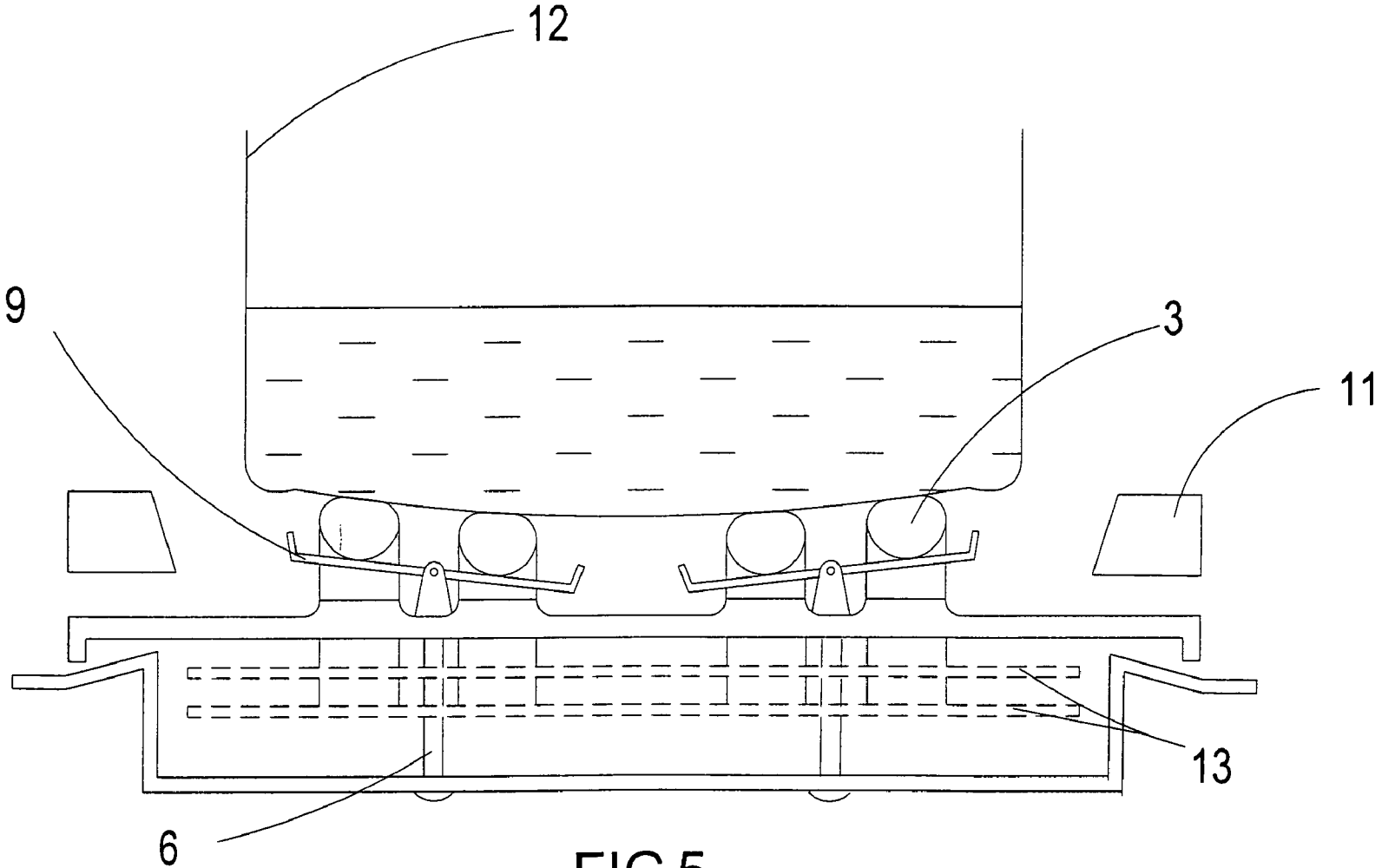
FIG. 5 shows a schematic motion diagram of the balance device according to the present invention (1).
Figure 6:
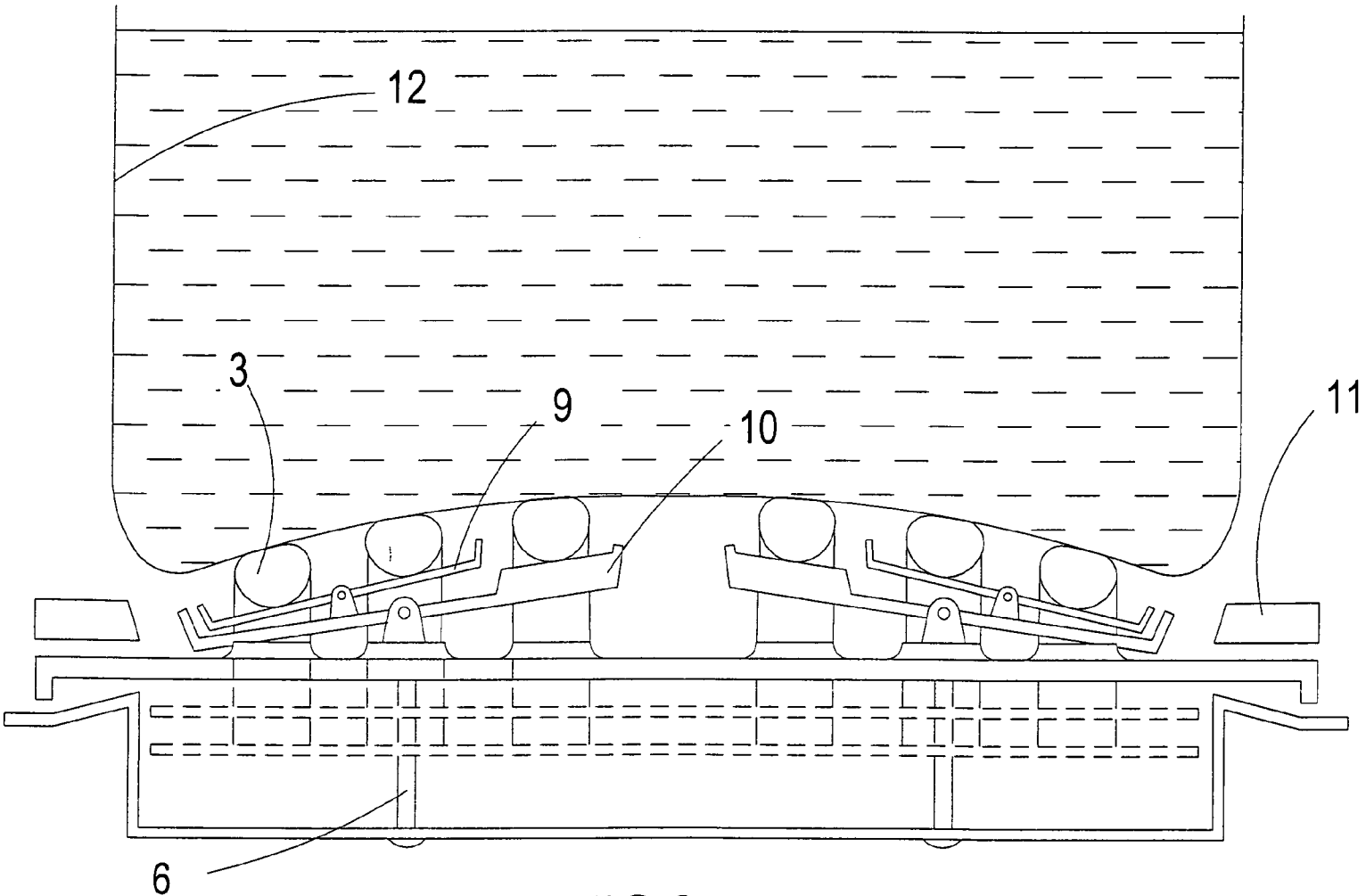
FIG. 6 shows a schematic motion diagram of the balance device according to the present invention (2).

Wherein, the heating element penetrates the fixing mount 1 and is fixedly configured atop insulation boards 13. When the body to be heated presses downwards and thereby comes in contact with the heating element, the balance device is thereby actuated, which thus effectuates clinging of the heating element to the body to be heated (see FIGS. 5, 6 an 7).

When utilizing a heating element autobalance device of the present invention, number of rings of heating elements 3 (see FIG. 4) can be increased according to requirements. Wherein, when number of rings of the heating elements 3 is relatively few, a body to be heated 12 is placed atop the heating elements 3, and after heating from below, a condition will occur whereby the heated body 12 bulges downward (see FIG. 5). Furthermore, when number of rings of the heating elements 3 is relatively many, and a relatively heavy substance is placed interior of the body to be heated 12, because of pressure from heavy weight above, a condition will occur whereby the heated body 12 will concave upward (see FIG. 6).

Figure 7:
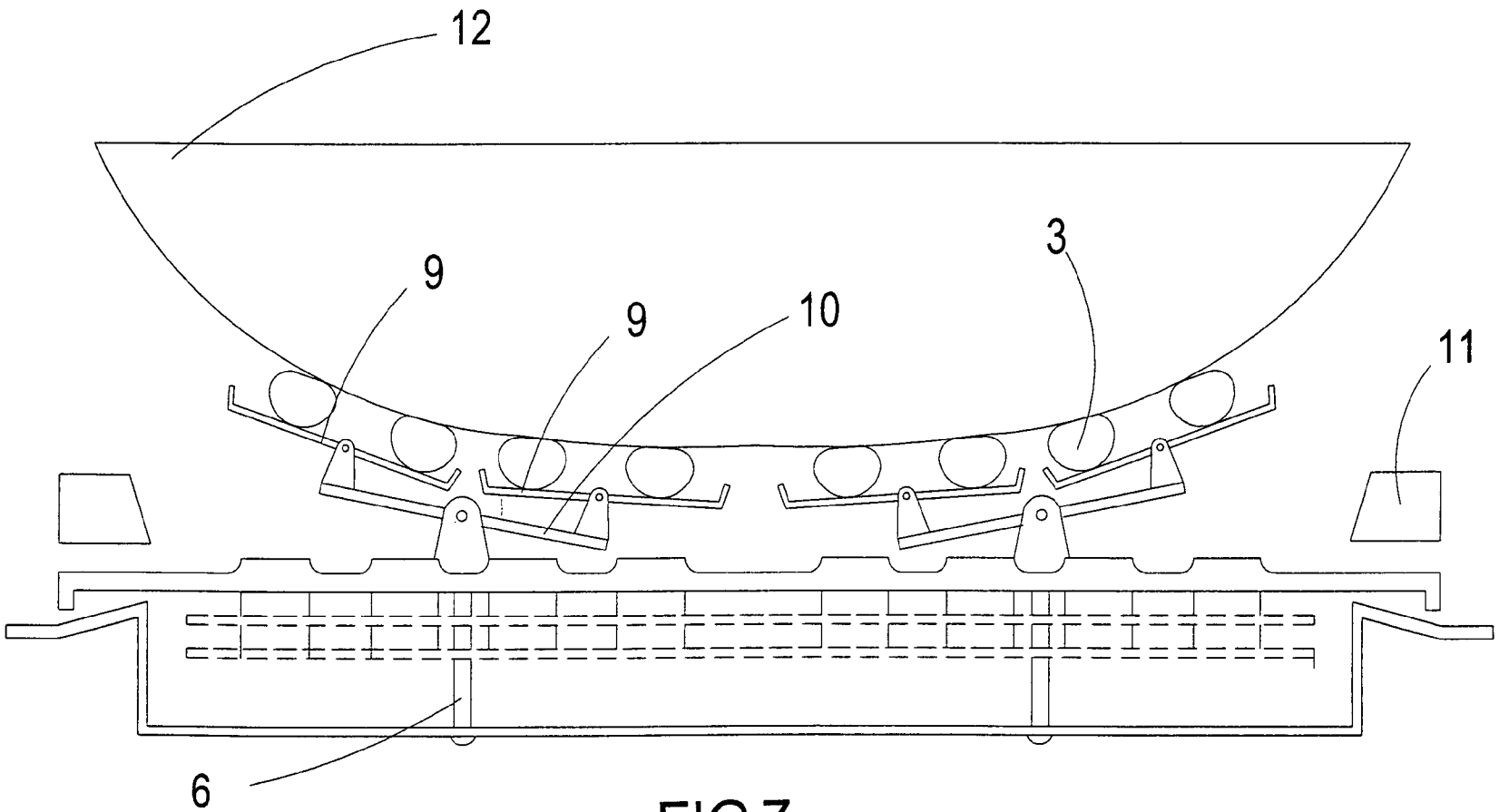
FIG. 7 shows a schematic motion diagram of the balance device according to the present invention (3).

Upon placing the body to be heated 12 atop a balance device 2, because exterior of the body to be heated 12 is subjected to thermal expansion and cold contraction, thus the exterior becomes curved. Upon the body to be heated 12 being placed atop the heating element 3, and weight of the body 12 presses downward, the heating element 3 actuates large rockers 10, which therewith cause a rear portion of the heating element 3 to raise upwards. Moreover, small rockers 9 are analogously pressed towards one side, which cause another side to raise upwards, thereby achieving clinging of the heating element 3 to the body to be heated 12 (see FIGS. 5, 6 and 7), and thus realizes superior heat transfer, and moreover, achieves effectiveness of even and rapid heating. Accordingly, the present invention assuredly provides convenience and practicability.

In order to better explicitly disclose advancement and practicability of the present invention, a comparison with a conventional charger is described hereinafter:

Shortcomings of Conventional Art

1. Uneven heating.
2. Placing a relatively small body to be heated upon a heating element results in exposing of an outer portion of the heating element, easily resulting in a dangerous predicament.
3. Lacks practicability.
4. Lacks advancement.

Advantages of the Present Invention

1. Capable of clinging to the body to be heated.
2. Rapid heating.
3. Greater power saving effectiveness compared to conventional art.
4. Suitable for application to any body to be heated.
5. Embodies convenience.
6. Embodies advancement.
7. Embodies commercial utility value.

In conclusion, the present invention in surmounting structural shortcomings of prior art has assuredly achieved effectiveness of anticipated advancement, and moreover, is easily understood by persons unfamiliar with related art. Furthermore, contents of the present invention have not been publicly disclosed prior to this application, and advancement and practicability of the present invention comply with essential elements as required for application of a new patent model. Accordingly, a patent application is proposed herein.

It is of course to be understood that the embodiments described herein is merely illustrative of the principles of the invention and that a wide variety of modifications thereto may be effected by persons skilled in the art without departing from the spirit and scope of the invention as set forth in the following claims.

What claimed is:

1. A heating element autobalance device comprising a fixing mount, a balance device, a heating element, a top cover, a bottom cover and a base, wherein the fixing mount is disposedly configured in the top cover, moreover, a blocking ring is configured atop the fixing mount, and functions in coordination with the lower base to achieve effectiveness of obviating stains arising from spillage, furthermore, the fixing mount is fixedly configured on the base by means of support rods; and characterized in that the balance device is configured atop the fixing mount, wherein the balance device comprises large rockers and small rockers, the small rockers are separately configured on another side of each of the large rockers, and which provide for disposing the heating element thereon, thereby achieving effectiveness and suitability for placing any body to be heated atop the heating element, wherein the heating element penetrates the fixing mount and is fixedly configured atop insulation boards, upon a body to be heated presses downwards and thereby comes in contact with the heating element, the balance device is thereby actuated, which thus effectuates clinging of the heating element to the body to be heated.

2. The heating element autobalance device of claim 1, wherein the balance device is further configured with small rockers separately configured on one side of each of the large rockers, and two small rockers separately configured atop two sides of each of the large rockers to form a small rocker configuration thereof.

* * * * *